United States Patent [19]

Kakuta

[11] 4,219,957

[45] Sep. 2, 1980

[54] TRAVELING TOY

[76] Inventor: Takao Kakuta, No. 12-11, Okamura 4-Chome, Isogo-Ku, Yokohama-Shi, Kanagawa-Ken, Japan

[21] Appl. No.: 911,072

[22] Filed: May 31, 1978

[51] Int. Cl.[2] ..... A63H 33/00

[52] U.S. Cl. ..... 46/1 C; 46/202; 46/251

[58] Field of Search ..... 46/1 C, 201, 202, 206, 46/216, 251, 257, 207

[56] References Cited

U.S. PATENT DOCUMENTS

| | | | |
|---|---|---|---|
| 3,136,549 | 6/1964 | Strayer | 46/1 C |
| 3,196,580 | 7/1965 | Rakestraw | 46/1 C |

*Primary Examiner*—Houston S. Bell, Jr.

*Attorney, Agent, or Firm*—Toren, McGeady and Stanger

[57] ABSTRACT

A traveling toy wherein an eccentric vibrator is coupled to a driving shaft, a brush inclining rearwards is secured to the lower surface of the toy proper, the toy proper is oscillated by the rotation of the vibrator, and the oscillations are transmitted to the brush, thereby causing the toy to run.

6 Claims, 7 Drawing Figures

(A)

(B)

TRAVELING TOY

BACKGROUND OF THE INVENTION

This invention relates to a traveling toy. More particularly, it relates to a traveling toy in which the toy body is oscillated by the rotation of an eccentric rotor so that it may be caused to run by the oscillations.

In some conventional traveling toys, a motor is driven by electric power of, e.g., a battery, and running wheels are rotated by the driving force of the motor, thereby causing the toy to travel. In others, running wheels are rotated through gears by utiliing the rotational inertia of a rotary member, thereby causing the toy to travel.

SUMMARY OF THE INVENTION

An object of this invention is to provide a traveling toy which can run with a simple mechanism requiring neither running wheels nor a complicated power transmission system such as gears and belts for rotating the running wheels.

Another object of this invention is to provide a traveling toy which can readily execute a change of direction together with random motions.

Still another object of this invention is to provide a traveling toy which, when formed into e.g. a helicopter, permits propellers or the like accessories to freely rotate and in which, even when the rotations of the accessories are stopped by fingers, a driving mechanism and other mechanisms do not malfunction.

A further object of this invention is to provide a traveling toy which can be fabricated at low cost.

BRIEF DESCRIPTION OF THE DRAWINGS

These objects and features of this invention will become apparent from the detailed description taken with reference to the accompanying drawings, in which.

DETAILED DESCRIPTION OF THE PREFERRED EMBODIMENTS

Figure 1:
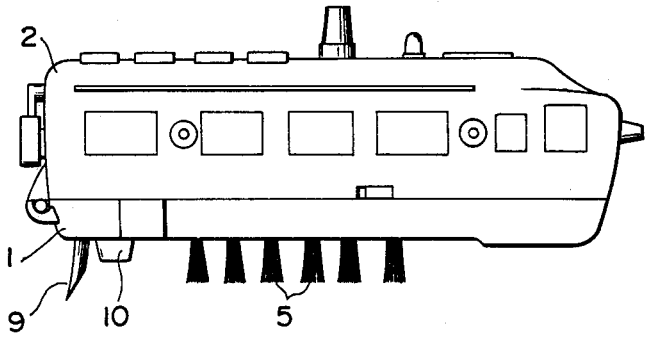
FIG. 1 illustrates an embodiment of this invention directed to a toy vehicle.
Figure 2:
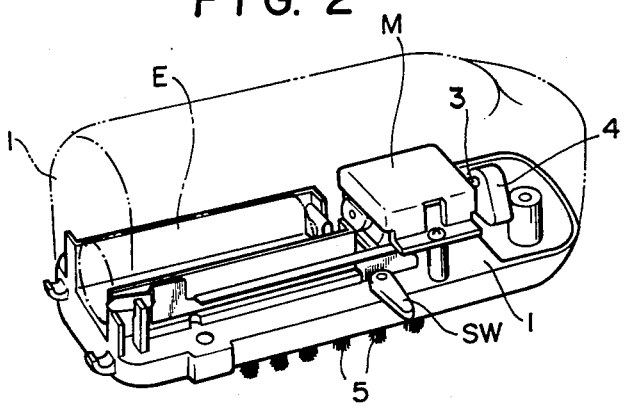
FIG. 2 is a schematic perspective view showing the internal mechanism of the embodiment in FIG. 1.
Figure 3:
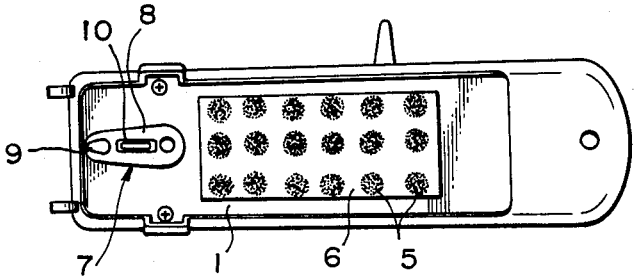
FIG. 3 is a schematic plan view showing the bottom part of the embodiment in FIG. 1.

FIGS. 1 to 3 illustrate an embodiment of a traveling toy according to this invention. The embodiment is directed to a vehicle.

As shown in FIG. 1, a base plate 1 is overlaid with a vehicular body frame 2.

As seen from FIG. 2, a motor M is disposed on the upper surface of the base plate 1. A motor shaft 3 protrudes from the motor M. Secured to the front end of the motor shaft 3 is an eccentric type vibrator 4 which is substantially sectoral.

A power source E for driving the motor M is also arranged on the base plate 1. The battery E is connected to the motor M through a switch Sw.

On the other hand, a brush plate 6 is secured to substantially the central part of the lower surface of the base plate 1 as shown in FIG. 3. In the brush plate 6, a brush 5 is planted in a manner to incline approximately 10° rearwards. This brush corresponds to running wheels of conventional traveling toys.

At a rear end part of the lower surface of the base plate 1, there is disposed a steering mechanism 7 for changing the advancing direction of the toy. The steering mechanism 7 is composed of a plate 8 which is pivotally supported in parallel with the base plate 1, a rubber member 9 which is longer than the bristles of the brush 5, which is flexible and which is protuberantly provided at the rear end of the plate 8 perpendicularly to a traveling floor F or to the base plate 1, and an operating knob 10 which is mounted on the plate 8 and which serves to turn this plate.

The rubber member 9 has its lower end bent by the weight of the toy proper and comes into contact with the traveling floor F. In a case where the toy travels, it can change the advancing direction owing to the friction between the lower end part of the rubber member and the traveling floor and the alteration of the position of the plate by turning.

The operation of the traveling toy having the above construction will now be explained. When the switch Sw is closed to drive the motor M, the vibrator 4 secured to the front end of the motor shaft 3 is rotated at high speed. Since the vibrator 4 is formed in an eccentric shape, the toy proper undergoes slight oscillations owing to the rotation. The brush 5 disposed on the lower surface of the base plate 1 is also oscillated by the oscillations for the toy proper, and a component of force of propelling the toy is caused owing to the rearward inclination of the brush 5, so that the toy executes the traveling operation.

Although no illustration is made in the drawings, when the toy is rendered operative while it is placed on a rail formed with a slot snugly fitting the brush, it can run along the rail.

Figure 4:
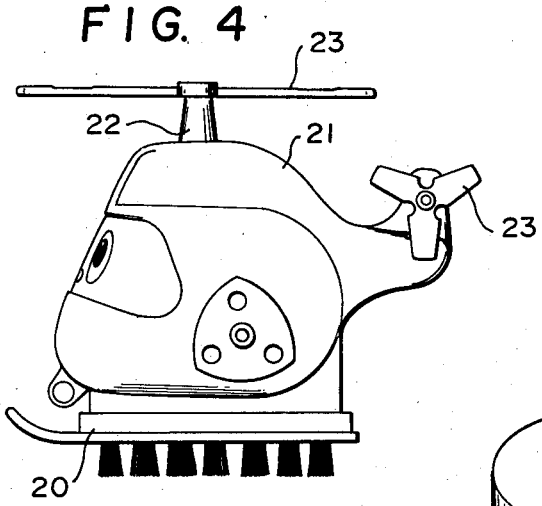
FIG. 4 is a view showing another embodiment of this invention.

FIG. 4 illustrates another embodiment of this invention, in which a proper frame 21 in the shape of a helicopter is put on a base plate 20. The vibrating mechanism which includes the power source E, the motor M and the vibrator is secured to the proper frame 21. Tubes 22 with fitting apertures are protuberantly disposed at upper, side and rear parts of the proper frame 21, respectively. Propellers 23 are rotatably and freely supported in the tubes 22 by, for example, pins.

With this construction, when the toy proper is oscillated by the rotation of the vibrator, the propellers 23 are also rotated. The traveling toy is attractive and interesting owing to the running of the toy proper and the rotations of the ornamental members 23. Inasmuch as the propellers 23 are merely fitted in the tubes 22 through the pins or the like, they can be simply attached or detached.

Figure 5:
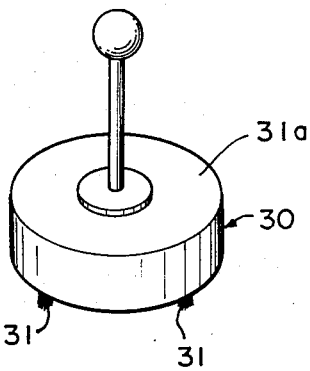
FIG. 5 is a view showing still another embodiment of this invention.
Figure 6:
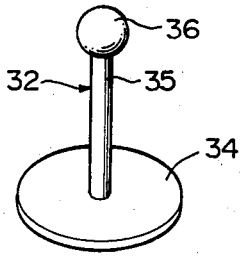
FIGS. 6(A) and 6(B) illustrate embodiments of toy members for use in combination with the traveling toy of the embodiment shown in FIG. 5.
Figure 6:
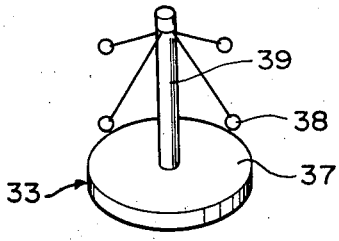

FIG. 5 illustrates still another embodiment of this invention. The vibrating mechanism is disposed in a cylindrical proper 30 as in the preceding embodiment, and a brush 31 is arranged at the bottom of the proper. An ornamental member 32 or 33 as shown in FIG. 6(A) or FIG. 6(B) is placed on the upper surface 31*a* of the cylindrical proper which is horizontal. Under this state, the toy is caused to travel.

The ornamental member 32 depicted in FIG. 6(A) consists of a plate 34 which is to be put on the flat upper surface 31*a*, a rod 35 which is vertically fixed on the plate 34, and a ball 36 which is placed on a recessed part at the upper end of the rod 35. The ornamental member 32 oscillates with the oscillations of the cylinder proper 30, whereby the ball 36 rotates.

The ornamental member 33 depicted in FIG. 6(B) consists of a plate 37, a post 39 which is vertically fixed on the plate 37, and small balls 38 which are suspended from the upper end of the post 39 by several strings. As the cylindrical proper 30 oscillates, the small balls 38 revolve round the post 39. In this manner, according to this embodiment, a unique traveling toy is obtained owing to the running of the cylindrical proper and the motion of the ornamental member placed thereon.

What I claim is:

1. A traveling toy comprising:

a base plate, a proper frame which is disposed on said base plate, a driving mechanism which is fixed to either of said base plate and said proper frame, an eccentric vibrator which is secured to a front end of a driving shaft of said driving mechanism and which is rotatably arranged, a brush which is disposed on a lower surface of said base plate in a manner to incline slightly rearwards, a steering mechanism mounted on a rear end part of said lower surface of said base plate, said steering mechanism consisting of a plate which is pivotally supported in parallel with said base plate, a rubber member which is longer than bristles of said brush, which is flexible and which is protuberantly disposed at a rear end of said plate substantially perpendicularly to said base plate, and an operating knob which serves to turn said plate.

2. A traveling toy according to claim 1, wherein said driving mechanism includes power supply means and a motor, said power supply means and said motor being connected through a switch.

3. A traveling toy according to claim 1, wherein tubes which have fitting apertures are protuberantly disposed on said proper frame, and ornamental members are rotatably and freely supported in said tubes by pins.

4. A traveling toy according to claim 1 wherein an ornamental member is placed on an upper surface of said proper frame, said ornamental member comprising an oscillating plate, a rod which is secured to said oscillating plate and a ball which is placed on a recessed part at an upper end of said rod.

5. A traveling toy according to claim 1, wherein an ornamental member is placed on an upper surface of said proper frame, said ornamental member comprising an oscillating plate, a post which is secured to an upper surface of said oscillating plate and balls which are supported from an upper end of said post by strings.

6. A traveling toy according to claim 1, wherein said proper frame is in the shape of a helicopter, a plurality of tubes each having a fitting aperture are protuberantly disposed on said proper frame, and a rotary member such as propeller is turnably and freely supported in said each tube by a pin or the like.

* * * * *